US007508254B2

(12) United States Patent
Hachiya et al.

(10) Patent No.: US 7,508,254 B2
(45) Date of Patent: Mar. 24, 2009

(54) REFERENCE SUPPLY VOLTAGE CIRCUIT USING MORE THAN TWO REFERENCE SUPPLY VOLTAGES

(75) Inventors: Yoshiaki Hachiya, Shiga (JP); Ryutaro Arakawa, Hyogo (JP); Takashi Kunimatsu, Shiga (JP); Minoru Fukui, Osaka (JP)

(73) Assignee: Panasonic Corporation, Osaka (JP)

( * ) Notice: Subject to any disclaimer, the term of this patent is extended or adjusted under 35 U.S.C. 154(b) by 41 days.

(21) Appl. No.: 11/723,530

(22) Filed: Mar. 20, 2007

(65) Prior Publication Data

US 2007/0229148 A1 Oct. 4, 2007

(30) Foreign Application Priority Data

Mar. 30, 2006 (JP) ..... 2006-092988

(51) Int. Cl.
*G05F 1/10* (2006.01)

(52) U.S. Cl. ..... 327/540; 327/143

(58) Field of Classification Search ..... 327/538–540, 327/530, 378, 142–143, 545
See application file for complete search history.

(56) References Cited

U.S. PATENT DOCUMENTS 6,882,213 B2 * 4/2005 Kim ..... 327/512
7,271,636 B2 * 9/2007 Yamamoto et al. ..... 327/205

FOREIGN PATENT DOCUMENTS

JP 2001-224169 8/2001

* cited by examiner

*Primary Examiner*—Dinh T. Le
(74) *Attorney, Agent, or Firm*—Wenderoth, Lind & Ponack, L.L.P.

(57) ABSTRACT

A reference supply voltage circuit includes a detecting device for detecting a first reference voltage, a comparator, and a preventing circuit for preventing any false operation during pre-operation indefinite time interval. The comparator outputs a signal which controls an operation circuit whose supply voltage is a second reference voltage equal to or lower than the first reference voltage. The preventing circuit maintains the second reference voltage to a circuit reference potential when the first reference voltage is lower than a first predetermined voltage, sets the second reference voltage to a voltage equal to the first reference voltage when the first reference voltage is equal to or higher than the first predetermined voltage and lower than a second predetermined voltage, and sets the second reference voltage to a voltage proportional to the first reference voltage when the first reference voltage is equal to or higher than the second predetermined voltage.

10 Claims, 6 Drawing Sheets

REFERENCE SUPPLY VOLTAGE CIRCUIT USING MORE THAN TWO REFERENCE SUPPLY VOLTAGES

BACKGROUND OF THE INVENTION

1. Field of the Invention

The present invention relates to a reference supply voltage circuit, and particularly, relates to a reference supply voltage circuit which uses more than two reference supply voltages.

2. Description of the Related Art

There is disclosed in Japanese Patent Laid-Open Publication No. 2001-224169 a semiconductor device for a switching power supply of prior art which reduces electric power consumption to improve power supply efficiency by reducing switching loss during a light load by a simple configuration. A control circuit of the semiconductor device for the switching power supply has an error amplifier for generating an error voltage signal made from a difference between a supplemental supply voltage and a reference voltage, and an element current detecting comparator for comparing an element current detection signal detected by a current detecting circuit with the error voltage signal. Further, the control circuit has a light load detecting circuit which stops outputting a switching signal to a switching device with respect to a switching signal control circuit when the error voltage signal is smaller than a lower limit voltage value, and starts outputting the switching signal with respect to the switching signal control circuit when the error voltage signal is larger than an upper limit voltage value.

However, in the semiconductor device for the switching power supply of the prior art, in the case where a high supply voltage (for example, equal to or higher than 15V) is required, there is such a problem that the circuit size increases and becomes unsuitable for a reduction in size because a plurality of high withstand voltage circuit elements are required. For this problem, there is considered a method which reduces the number of necessary high withstand voltage circuit elements by dividing the circuit configuration into one circuit for operating by a first reference supply voltage and another circuit for operating by a second reference supply voltage which is equal to or lower than the first reference supply voltage. However, in this case, a difference between threshold voltages of the circuit elements in both internal circuits increases, and this may lead to a false operation of the whole circuit.

SUMMARY OF THE INVENTION

An essential object of the present invention is to solve the aforementioned problems, and to provide a reference supply voltage circuit which is safe and suitable for reduction in size even when a high reference supply voltage is used in a reference supply voltage circuit having more than two reference supply voltages.

According to the first aspect of the present invention, there is provided a reference supply voltage circuit, comprising a detecting device, a comparator and a circuit for preventing any false operation during a pre-operation indefinite time interval. The detecting device detects a first reference voltage of a first reference voltage source. The comparator outputs a signal which controls an operation state and a stop state of an operation circuit whose supply voltage is a second reference voltage of a second reference voltage source that is equal to or lower than the first reference voltage, by comparing the first reference voltage detected by the detecting device with a predetermined reference detection voltage. The circuit for preventing any false operation during the pre-operation indefinite time interval maintains the second reference voltage to a circuit reference potential when the first reference voltage is lower than a first predetermined voltage, sets the second reference voltage to a voltage equal to the first reference voltage when the first reference voltage is equal to or higher than the first predetermined voltage and lower than a second predetermined voltage, and sets the second reference voltage to a voltage proportional to the first reference voltage when the first reference voltage is equal to or higher than the second predetermined voltage.

In the above-mentioned reference supply voltage circuit, the first predetermined voltage is equal to or higher than a voltage at which an operation circuit whose supply voltage is the second reference voltage can be stably operated, and the second predetermined voltage is equal to or higher than a voltage at which an operation circuit whose supply voltage is the first reference voltage can be stably operated.

In addition, in the above-mentioned reference supply voltage circuit, the circuit for preventing any false operation during the pre-operation indefinite time interval comprises a diode section, a first resistor, a first switching device and a second switching device. The diode section has a cathode electrode connected to the circuit reference potential, and supplies a forward voltage that is the second predetermined voltage. The first resistor is connected between the first reference voltage source and an anode electrode of the diode section. The first switching device has one side electrode connected to the first reference voltage source, the other side electrode connected to the circuit reference potential via a second resistor, and a control electrode connected to the anode electrode of the diode section. The second switching device has one side electrode connected to the first reference voltage source, the other side electrode connected to the second reference voltage source, and a control electrode connected to a connecting node between the second resistor and the first switching device.

Further, in the above-mentioned reference supply voltage circuit, the diode section comprises a plurality of diodes connected in series with each other.

Still further, in the above-mentioned reference supply voltage circuit, the diode section comprises a plurality of bipolar transistors connected in series with each other.

In addition, in the above-mentioned reference supply voltage circuit, the first and second switching devices are P-type transistors, respectively.

While the novel features of the invention are set forth particularly in the appended claims, the invention, both as to organization and content, will be better understood and appreciated, along with other objects and features thereof, from the following detailed description taken in conjunction with the drawings.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
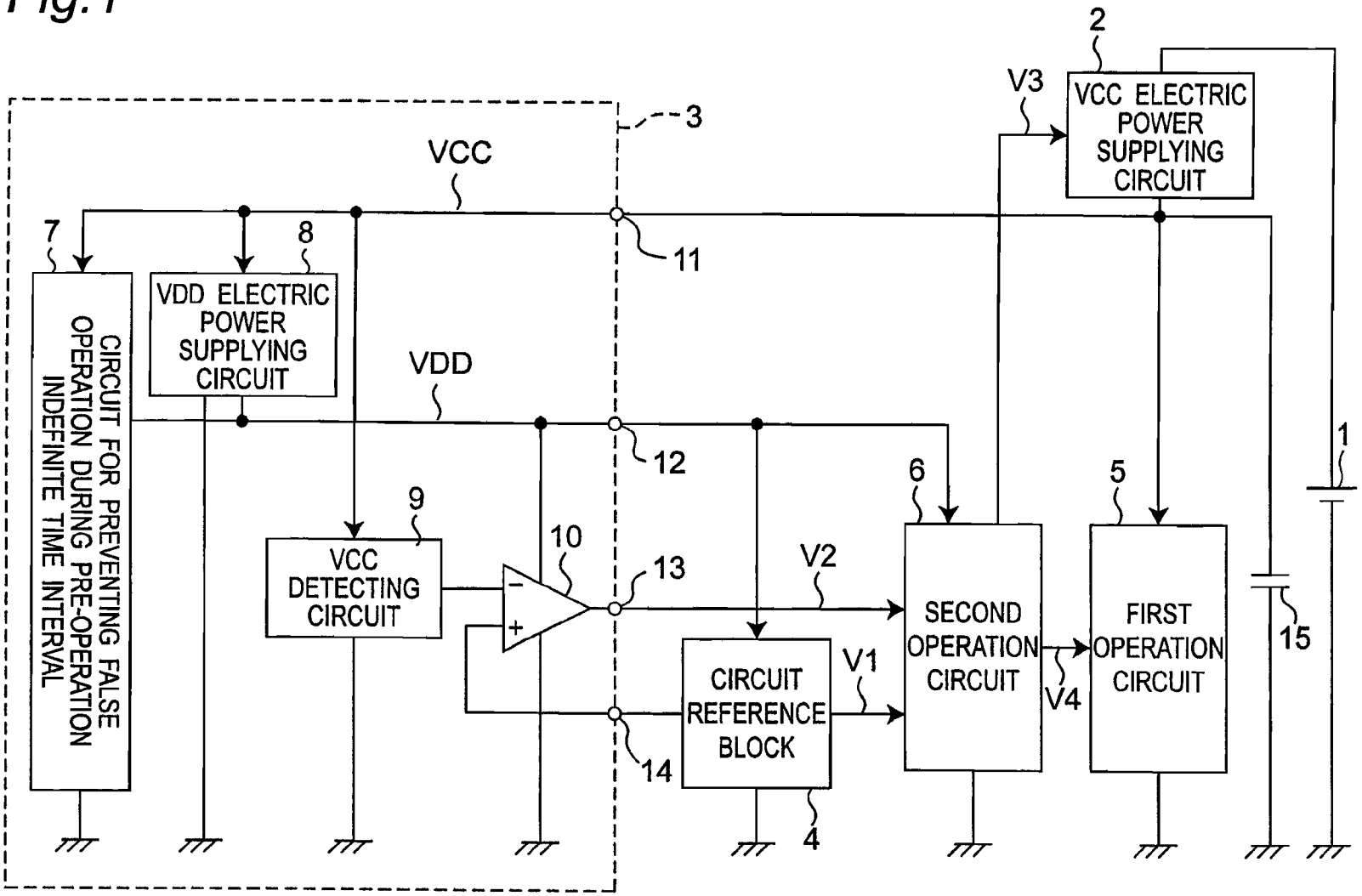
FIG. 1 is a circuit diagram showing a configuration of a semiconductor device provided with a reference supply voltage circuit 3 according to a preferred embodiment 1 of the present invention.

Preferred embodiments according to the present invention will be described with reference to the drawings hereinafter. Further, in the following each preferred embodiment, the same reference numerals are given to the same components.

Preferred Embodiment 1

FIG. 1 is a circuit diagram showing a configuration of a semiconductor device provided with a reference supply voltage circuit 3 according to a preferred embodiment 1 of the present invention. The semiconductor device shown in FIG. 1 includes a power supply 1, a VCC electric power supplying circuit 2, a reference supply voltage circuit 3, a circuit reference block 4, a first operation circuit 5, a second operation circuit 6, and a capacitor 15. The reference supply voltage circuit 3 includes a circuit 7 for preventing any false operation during a pre-operation indefinite time interval, a VDD electric power supplying circuit 8, a VCC detecting circuit 9, a comparator 10, a VCC terminal 11, a VDD terminal 12, a V2 terminal 13, and a VBG terminal 14.

Referring to FIG. 1, an anode side of the power supply 1 is connected to the VCC electric power supplying circuit 2, and a cathode side thereof is connected to a ground potential. One side terminal of the capacitor 15 is connected to the VCC electric power supplying circuit 2, the first operation circuit 5, and the VCC terminal 11 of the reference supply voltage circuit 3; and the other side terminal thereof is connected to the ground potential. The VCC electric power supplying circuit 2 is connected to the anode side of the power supply 1, the one side terminal of the capacitor 15, the first operation circuit 5, the second operation circuit 6, and the VCC terminal 11 of the reference supply voltage circuit 3. The first operation circuit 5 is connected to the VCC electric power supplying circuit 2, the one side terminal of the capacitor 15 and the second operation circuit 6. The second operation circuit 6 is connected to the VDD terminal 12 of the reference supply voltage circuit 3, the V2 terminal 13 of the reference supply voltage circuit 3, the circuit reference block 4, the VCC electric power supplying circuit 2, and the first operation circuit 5. The circuit reference block 4 is connected to the VDD terminal 12 of the reference supply voltage circuit 3, the VBG terminal 14 of the reference supply voltage circuit 3, and the second operation circuit 6.

The VDD electric power supplying circuit 8 is connected to the VCC terminal 11, the VDD terminal 12, and the circuit 7 for preventing any false operation during the pre-operation indefinite time interval. The VCC detecting circuit 9 is connected to the VCC terminal 11, and an inversion input terminal of the comparator 10. The circuit 7 for preventing any false operation during the pre-operation indefinite time interval is connected to the VCC terminal 11, the VDD terminal 12, and the VDD electric power supplying circuit 8. The inversion input terminal of the comparator 10 is connected to the VCC detecting circuit 9, a non-inversion input terminal thereof is connected to the VBG terminal 14, and an output terminal thereof is connected to the V2 terminal 13. In addition, the comparator 10 is connected to a VDD potential and the ground potential as reference potentials of an output signal.

The VCC electric power supplying circuit 2 inputs a supply voltage from the power supply 1, generates a VCC level voltage, and supplies the same to the reference supply voltage circuit 3 and the first operation circuit 5. The VDD electric power supplying circuit 8 inputs the VCC level voltage supplied by the VCC electric power supplying circuit 2 via the VCC terminal 11, generates a VDD level voltage, and supplies the same to the circuit reference block 4 and the second operation circuit 6 via the VDD terminal 12.

The circuit reference block 4 inputs a voltage at the VDD terminal 12; when the voltage at the VDD terminal 12 is lower than a predetermined voltage VDD_0, the circuit reference block 4 judges that the second operation circuit 6 cannot be stably operated, and outputs a V1 signal having a low level to control the second operation circuit 6 to be in a stop state. When the voltage at the VDD terminal 12 is equal to or higher than the predetermined voltage VDD_0, the circuit reference block 4 judges that the second operation circuit 6 can be stably operated, and outputs the V1 signal having a high level to control the second operation circuit 6 to be in an operation state. In addition, the circuit reference block 4 generates a detection reference voltage (referred to as a voltage VBG hereinafter) which is used for comparing by the comparator 10 of the reference supply voltage circuit 3, and outputs the same to the comparator 10 via the VBG terminal 14.

The second operation circuit 6 operates using the voltage at the VDD terminal 12 as a reference voltage. The second operation circuit 6 is controlled to be in the stop state when the V1 signal from the circuit reference block 4 has the low level, and the second operation circuit 6 is controlled to be in the operation state when the V1 signal has the high level. In addition, the second operation circuit 6 outputs a V4 signal having the low level to control the first operation circuit 5 to be in the stop state when a V2 signal inputted from the comparator 10 of the reference supply voltage circuit 3 via the V2 terminal 13 has the low level; and the second operation circuit 6 outputs the V4 signal having the high level to control the first operation circuit 5 to be in the operation state when both of the V1 signal and the V2 signal have the high level. Further, in order to maintain an output voltage from the VCC electric power supplying circuit 2 to be constant, the second operation circuit 6 generates a V3 signal for controlling the VCC electric power supplying circuit 2, and outputs the same. The first operation circuit 5 inputs the voltage at the VCC terminal 11 supplied by the VCC electric power supplying circuit 2 as a reference voltage, and switches the stop state and the operation state depending on the V4 signal from the second operation circuit 6.

The VCC detecting circuit 9 detects the voltage at the VCC terminal 11, and outputs a voltage corresponding to the voltage at the VCC terminal 11 to the comparator 10. The comparator 10 compares the voltage VBG inputted to the VBG terminal 14 with the voltage corresponding to the voltage at the VCC terminal 11 from the VCC detecting circuit 9, the comparator 10 judges that the first operation circuit 5 can be stably operated when the voltage VBG is higher than the voltage corresponding to the voltage at the VCC terminal 11, and outputs the V2 signal having the high level to switch the first operation circuit 5 into the operation state. The comparator 10 judges that the first operation circuit 5 cannot be stably operated when the voltage VBG is equal to or lower than the voltage corresponding to the voltage at the VCC terminal 11, and outputs the V2 signal having the low level to switch the first operation circuit 5 into the stop state. The voltage VBG is set to be a value which is equal to a voltage value outputted from the VCC detecting circuit 9 when the voltage at the VCC terminal 11 is VCC_0.

The circuit 7 for preventing any false operation during the pre-operation indefinite time interval maintains the voltage at the VDD terminal 12 to be zero potential until the inputted voltage at the VCC terminal 11 reaches a predetermined voltage VCCm. In addition, the circuit 7 for preventing any false operation during the pre-operation indefinite time interval sets the voltage at the VDD terminal 12 to be a voltage equal to the voltage at the VCC terminal 11 when the inputted voltage at the VCC terminal 11 is equal to or higher than the predetermined voltage VCCm and lower than a voltage VCC_1, and sets the voltage at the VDD terminal 12 to be a voltage proportional to the voltage at the VCC terminal 11 when the inputted voltage at the VCC terminal 11 is equal to or higher than the voltage VCC_1.

Figure 2:
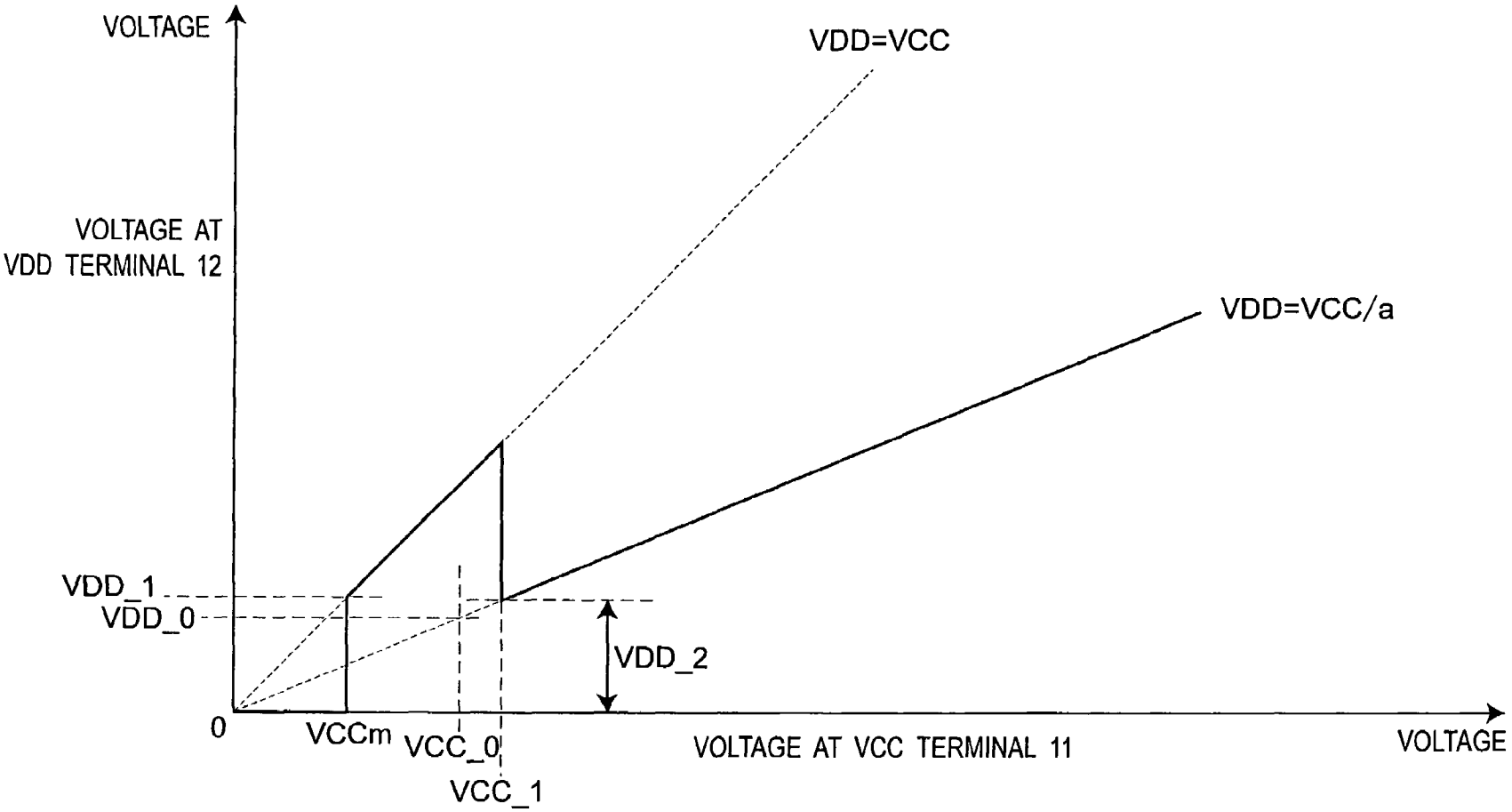
FIG. 2 is a correlation diagram showing a correlation between voltages at a VCC terminal 11 and a VDD terminal 12 on start-up of the reference supply voltage circuit 3 shown in FIG. 1.

Next, referring to FIG. 2, an operation of the semiconductor device provided with the reference supply voltage circuit 3 according to the present preferred embodiment will be described. FIG. 2 is a correlation diagram showing a correlation between voltages at the VCC terminal 11 and the VDD terminal 12 on start-up of the semiconductor device provided with the reference supply voltage circuit 3 as configured in FIG. 1. In FIG. 2, the voltage VDD_0 shows the minimum voltage at the VDD terminal 12 at which the second operation circuit 6, which operates using the voltage at the VDD terminal 12 as the reference voltage, can be stably operated. That is, when the voltage at the VDD terminal 12 is lower than the voltage VDD_0, the second operation circuit 6, which operates using the voltage at the VDD terminal 12 as the reference voltage, becomes unstable. The voltage VCC_0 shows the minimum voltage at the VCC terminal 11 at which the first operation circuit 5, which operates using the voltage at the VCC terminal 11 as the reference voltage, can be stably operated. That is, when the voltage at the VCC terminal 11 is lower than the voltage VCC_0, the first operation circuit 5, which operates using the voltage at the VCC terminal 11 as the reference voltage, becomes unstable.

First of all, when the power supply 1 is applied, the capacitor 15 connected to the VCC potential is charged by the VCC electric power supplying circuit 2, and the voltage at the VCC terminal 11 gradually increases. In a state where the voltage at the VCC terminal 11 is lower than the voltage VCCm, the voltage at the VDD terminal 12 is maintained to zero potential by the circuit 7 for preventing any false operation during the pre-operation indefinite time interval. When the voltage at the VCC terminal 11 further increases and reaches equal to or higher than the voltage VCCm, the voltage at the VDD terminal 12 is switched over from zero potential to a voltage VDD_1 equal to the voltage at the VCC terminal 11. At this time, the voltage VDD_1 satisfies a relationship of VDD_1>VDD_0. Therefore, the second operation circuit 6 which operates using the voltage at the VDD terminal 12 as the reference voltage can be stably operated. The circuit reference block 4 outputs the V1 signal having the high level which controls the second operation circuit 6 to be in the operation state. The voltage at the VDD terminal 12 becomes a value equal to the voltage at the VCC terminal 11 until the voltage at the VCC terminal 11 reaches the voltage VCC_1.

Next, when the voltage at the VCC terminal 11 further increases and reaches the voltage VCC_1 higher than the voltage VCC_0, the voltage at the VDD terminal 12 is switched to a voltage VDD_2 which is lower than the voltage at the VCC terminal 11 and proportional to the voltage at the VCC terminal 11 (for example, as followed a function of VDD=VCC/a (where "a" is a number which is equal to or larger than one)). At this time, the first operation circuit 5 which operates using the voltage at the VCC terminal 11 as the reference voltage can be stably operated. The comparator 10 outputs the V2 signal having the high level which controls the first operation circuit 5 to be in the operation state. In addition, at this time, since the voltage VDD_2 is preliminarily set to satisfy a relationship of VDD_2>VDD_0, the second operation circuit 6 which operates using the voltage at the VDD terminal 12 as the reference voltage can be continuously stably operated. After that, the voltage at the VDD terminal 12 increases in proportion to the voltage at the VCC terminal 11 until the voltage at the VCC terminal 11 further increases and reaches a constant level. When the voltage at the VCC terminal 11 reaches the constant level, the second operation circuit 6 outputs the V3 signal to the VCC electric power supplying circuit 2, and controls the output voltage from the VCC electric power supplying circuit 2 to be constant.

As described above, according to the reference supply voltage circuit 3 according to the present preferred embodiment, on starting up or re-starting up or the like, the voltage at the VDD terminal 12 is always maintained to zero potential during an indefinite time interval while a voltage lower than the voltage VDD_0 is inputted in a conventional art; and at the same time, the voltage VDD_1 higher than the voltage VDD_0 is applied to the second operation circuit 6 at the time when a voltage equal to or higher than the voltage VDD_0 is certainly supplied. Accordingly, the second operation circuit 6 using the voltage at the VDD terminal 12 as the reference voltage can be stably operated, and the first operation circuit 5 can be stably controlled, and therefore, a false operation of the whole circuit can be reduced. In addition, even when the voltage at the VDD terminal 12 lower than the voltage at the VCC terminal 11 is used, a VDD voltage equal to the voltage at the VCC terminal 11 is once applied, and therefore, the second operation circuit 6 can be operable in a short time and can make the start-up faster.

Preferred Embodiment 2

Figure 3:
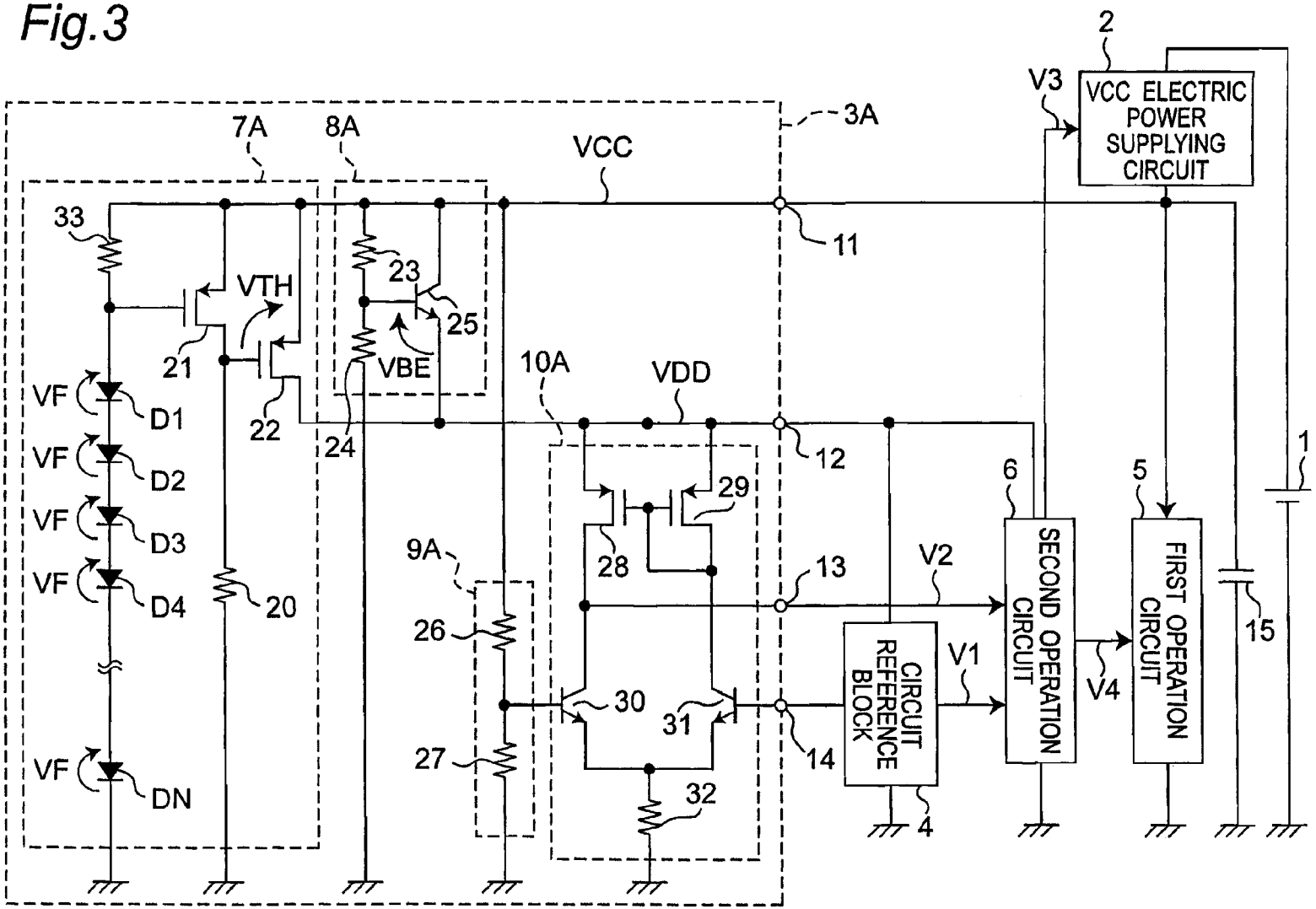
FIG. 3 is a circuit diagram showing a configuration of a semiconductor device provided with a reference supply voltage circuit 3A according to a preferred embodiment 2 of the present invention.

FIG. 3 is a circuit diagram showing a configuration of a semiconductor device provided with a reference supply voltage circuit 3A according to a preferred embodiment 2 of the present invention. The semiconductor device in the present preferred embodiment differs from the semiconductor device according to the preferred embodiment 1 shown in FIG. 1 in that the reference supply voltage circuit 3A is provided in place of the reference supply voltage circuit 3. The reference supply voltage circuit 3A includes a circuit 7A for preventing any false operation during a pre-operation indefinite time interval, a VDD electric power supplying circuit 8A, a VCC detecting circuit 9A, and a comparator 10A. In other respects, the configuration of the semiconductor device according to the present preferred embodiment is the same as that of the semiconductor device according to the preferred embodiment 1 shown in FIG. 1, and components labeled with the same reference numerals have the same configurations and functions, and therefore, their repeated detailed description will be omitted.

Referring to FIG. 3, the circuit 7A for preventing any false operation during the pre-operation indefinite time interval includes N diodes D1 to DN connected in series with each other, resistors 20 and 33, and field-effect transistors 21 and 22. The resistors 33 and the diodes D1 to DN are connected in series with each other in this order between the VCC potential and the ground potential. A source electrode of the field-effect transistor 21 is connected to the VCC potential, a drain electrode thereof is connected to the resistor 20 and a gate electrode of the field-effect transistor 22, and a gate electrode thereof is connected to a connecting node between the resistor 33 and the diode D1. A source electrode of the field-effect transistor 22 is connected to the VCC potential, a drain electrode thereof is connected to a VDD potential, and the gate electrode thereof is connected to the drain electrode of the field-effect transistor 21. One side terminal of the resistor 20 is connected to the drain electrode of the field-effect transistor 21 and the gate electrode of the field-effect transistor 22, and the other side terminal thereof is connected to the ground potential. Further, a threshold voltage of the field-effect transistor 22 is labeled as VTH, a forward voltage at each of the diodes D1 to DN is labeled as VF, respectively, and a voltage generated when the all diodes D1 to DN are in the electrically conductive state is referred to as N·VF.

The VDD electric power supplying circuit 8A includes resistors 23 and 24, and a bipolar transistor 25. The resistors 23 and 24 are connected in series with each other in this order between the VCC potential and the ground potential. A collector electrode of the bipolar transistor 25 is connected to the VCC potential, an emitter electrode thereof is connected to the VDD potential, and a base electrode thereof is connected to a connecting node between the resistors 23 and 24. Further, a threshold voltage of the bipolar transistor 25 is labeled as VBE.

The VCC detecting circuit 9A includes resistors 26 and 27. The resistors 26 and 27 are connected in series with each other between the VCC potential and the ground potential.

The comparator 10A includes field-effect transistors 28 and 29, bipolar transistors 30 and 31, and a resistor 32. A source electrode of the field-effect transistor 28 is connected to the VDD potential, a drain electrode thereof is connected to a collector electrode of the bipolar transistor 30 and the V2 terminal 13, and a gate electrode thereof is connected to a gate electrode of the field-effect transistor 29. A source electrode of the field-effect transistor 29 is connected to the VDD potential; a drain electrode and the gate electrode thereof are connected to a collector electrode of the bipolar transistor 31. The collector electrode of the bipolar transistor 30 is connected to the drain electrode of the field-effect transistor 28 and the V2 terminal 13, an emitter electrode thereof is connected to an emitter electrode of the bipolar transistor 31 and one side terminal of the resistor 32, a base electrode thereof is connected to a connecting node between the resistors 26 and 27 in the VCC detecting circuit 9A. The collector electrode of the bipolar transistor 31 is connected to the gate electrode and the drain electrode of the field-effect transistor 29, the emitter electrode thereof is connected to the emitter electrode of the bipolar transistor 30 and the one side terminal of the resistor 32, the base electrode thereof is connected to the circuit reference block 4 via the VBG terminal 14. The one side terminal of the resistor 32 is connected to each of the emitter electrodes of the bipolar transistors 30 and 31, and the other side terminal thereof is connected to the ground potential.

Figure 4:
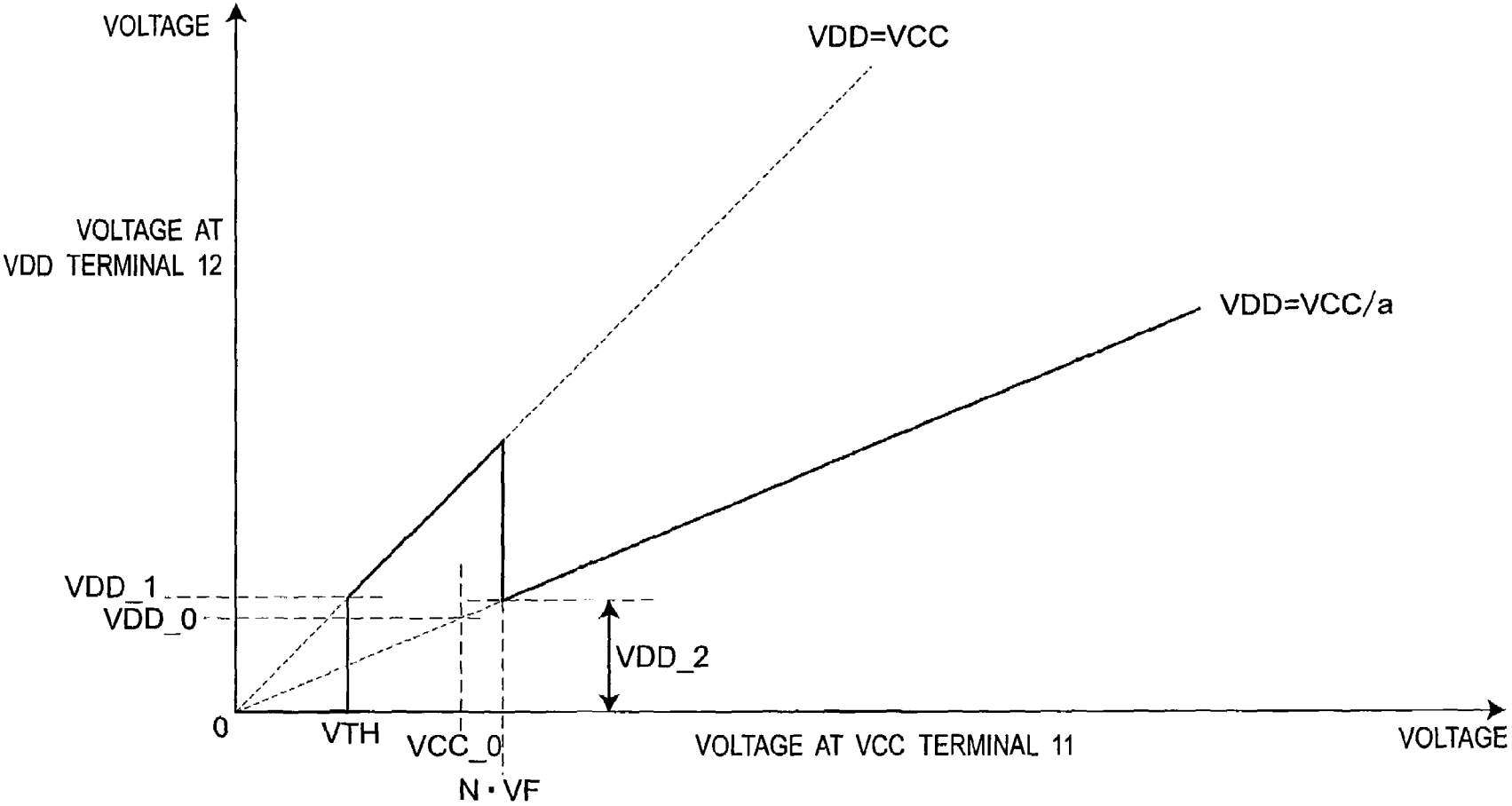
FIG. 4 is a correlation diagram showing a correlation between voltages at the VCC terminal 11 and the VDD terminal 12 on start-up of the reference supply voltage circuit 3A shown in FIG. 3.

Next, referring to FIG. 4, an operation of the semiconductor device provided with the reference supply voltage circuit 3A according to the present preferred embodiment will be described. FIG. 4 is a correlation diagram showing a correlation between voltages at the VCC terminal 11 and the VDD terminal 12 on start-up of the semiconductor device provided with the reference supply voltage circuit 3A as configured in FIG. 3. In FIG. 4, the voltage VDD_0 shows the minimum voltage at the VDD terminal 12 at which the second operation circuit 6, which operates using the voltage at the VDD terminal 12 as the reference voltage, can be stably operated. That is, when the voltage at the VDD terminal 12 is lower than the voltage VDD_0, the second operation circuit 6 which operates using the voltage at the VDD terminal 12 as the reference voltage becomes unstable. The voltage VCC_0 shows the minimum voltage at the VCC terminal 11 at which the first operation circuit 5, which operates using the voltage at the VCC terminal 11 as the reference voltage, can be stably operated. That is, when the voltage at the VCC terminal 11 is lower than the voltage VCC_0, the first operation circuit 5 which operates using the voltage at the VCC terminal 11 as the reference voltage becomes unstable. In addition, the threshold voltage VTH of the field-effect transistor 22 in the circuit 7A for preventing any false operation during the pre-operation indefinite time interval is preliminarily set to satisfy a relationship of VTH>VDD_0.

First of all, when the power supply 1 is applied, the capacitor 15 connected to the VCC potential is charged by the VCC electric power supplying circuit 2, and the voltage at the VCC terminal 11 gradually increases. In a state where the voltage at the VCC terminal 11 is lower than the threshold voltage VTH of the transistor 22, the transistor 22 does not operate, and therefore, the voltage at the VDD terminal 12 is maintained to zero potential that is a circuit reference voltage. When the voltage at the VCC terminal 11 further increases and reaches equal to or higher than the threshold voltage VTH of the transistor 22, the transistor 22 becomes in an ON-state and the voltage at the VDD terminal 12 is switched over from zero potential to the voltage VDD_1 equal to the voltage at the VCC terminal 11. At this time, the voltage VDD_1 satisfies a relationship of VDD_1>VDD_0. Therefore, the second operation circuit 6 which operates using the voltage at the VDD terminal 12 as the reference voltage can be stably operated. The circuit reference block 4 outputs the V1 signal having the high level which controls the second operation circuit 6 to be in the operation state. The voltage at the VDD terminal 12 becomes a value equal to the voltage at the VCC terminal 11 until the voltage at the VCC terminal 11 reaches from the voltage VTH to the voltage N·VF.

Next, when the voltage at the VCC terminal 11 further increases and reaches the voltage N·VF, the N diodes D1 to DN become in the conductive state, and the transistor 21 becomes in an ON-state. Therefore, the voltage at the gate electrode of the transistor 21 becomes equal to the voltage at the VCC terminal 11, and the transistor 22 becomes in an OFF-state. Accordingly, the voltage at the VDD terminal 12 decreases to the voltage VDD_2 that is a voltage obtained by subtracting the threshold voltage VBE of the transistor 25 from a voltage divided by the resistors 23 and 24 of the VDD electric power supplying circuit 8. At this time, the first operation circuit 5 which operates using the voltage at the VCC terminal 11 as the reference voltage can be stably operated. The comparator 10A outputs the V2 signal having the high level which controls the first operation circuit 5 to be in the operation state. In addition, at this time, since the voltage VDD_2 is preliminarily set to satisfy a relationship of VDD_2>VDD_0, the second operation circuit 6 which operates using the voltage at the VDD terminal 12 as the reference voltage can be continuously stably operated. After that, the voltage at the VDD terminal 12 increases in proportion to the voltage at the VCC terminal 11 until the voltage at the VCC terminal 11 further increases and reaches a constant level. When the voltage at the VCC terminal 11 reaches the constant level, the second operation circuit 6 outputs the V3 signal to the VCC electric power supplying circuit 2, and controls the output voltage at the VCC electric power supplying circuit 2 to be constant.

As described above, according to the reference supply voltage circuit 3A according to the present preferred embodiment, a reference supply voltage circuit having effects equivalent to those in the preferred embodiment 1 can be easily realized by the above circuit configuration. In addition, the voltage N·VF which is used for switching the voltage at the VDD terminal 12 can be easily adjusted to other values by adjusting the number of the diodes D1 to DN.

Preferred Embodiment 3

Figure 5:
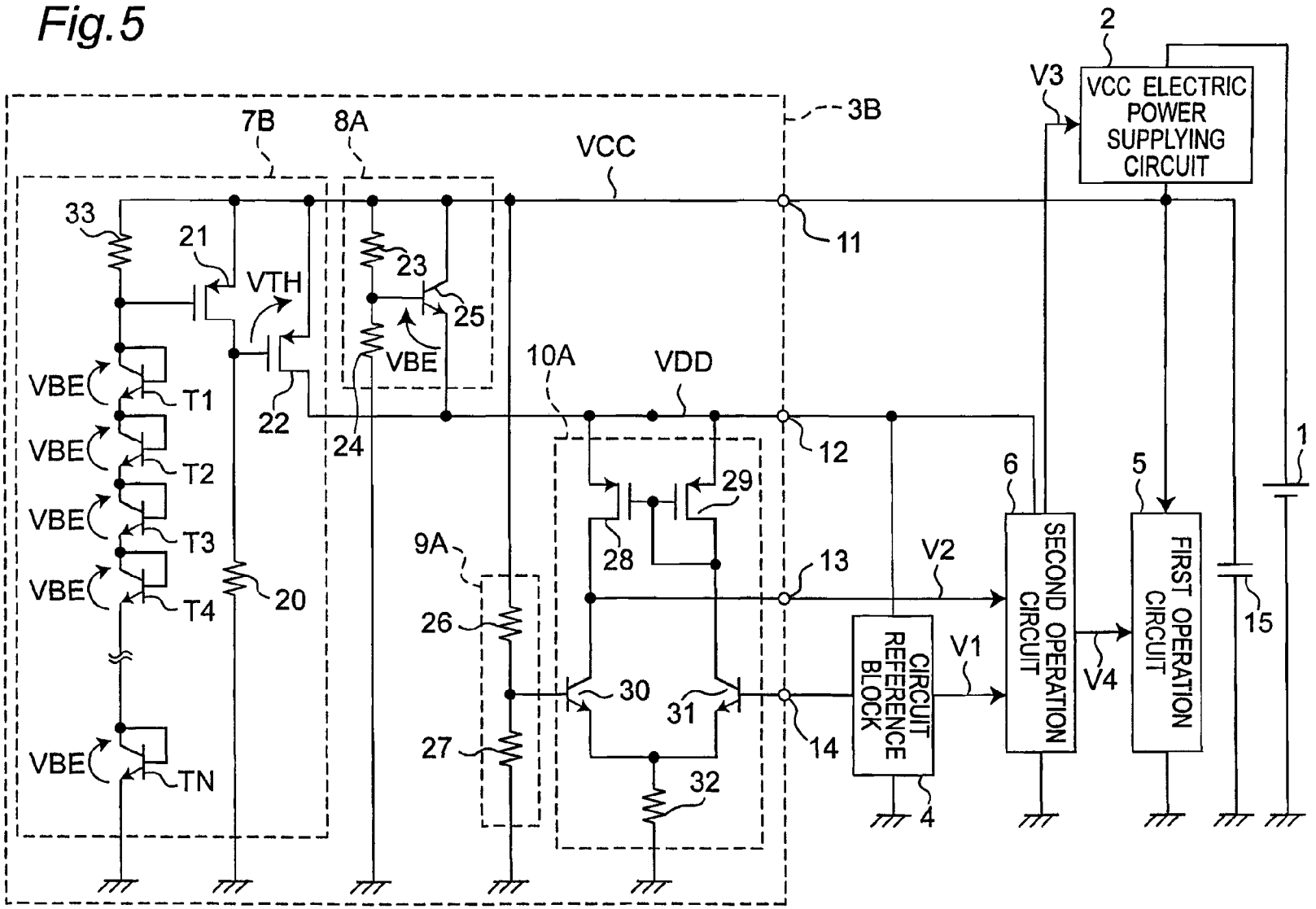
FIG. 5 is a circuit diagram showing a configuration of a semiconductor device provided with a reference supply voltage circuit 3B according to a preferred embodiment 3 of the present invention.

FIG. 5 is a circuit diagram showing a configuration of a semiconductor device provided with a reference supply voltage circuit 3B according to a preferred embodiment 3 of the present invention. The semiconductor device according to the present preferred embodiment differs from the semiconductor device according to the preferred embodiment 2 shown in FIG. 3 in that the reference supply voltage circuit 3B is provided in place of the reference supply voltage circuit 3A shown in FIG. 3. The reference supply voltage circuit 3B differs from the reference supply voltage circuit 3A according to the preferred embodiment 2 shown in FIG. 3 in that a circuit 7B for preventing any false operation during a pre-operation indefinite time interval is provided in place of the circuit 7A for preventing any false operation during the pre-operation indefinite time interval. The circuit 7B for preventing any false operation during the pre-operation indefinite time interval differs from the circuit 7A for preventing any false operation during the pre-operation indefinite time interval according to the preferred embodiment 2 shown in FIG. 3 in that bipolar transistors T1 to TN connected in series with each other are provided in place of the diodes D1 to DN. In other respects, the configuration of the semiconductor device according to the present preferred embodiment is the same as that of the semiconductor device according to the preferred embodiment 2 shown in FIG. 3, and components labeled with the same reference numerals have the same configurations and functions, and therefore, their repeated detailed description will be omitted.

Referring to FIG. 5, a forward voltage at each of the bipolar transistors T1 to TN provided in the circuit 7B for preventing any false operation during the pre-operation indefinite time interval is labeled as VBE, and a voltage generated when all the bipolar transistors T1 to TN are in the electrically conductive state is referred to as N·VBE.

Figure 6:
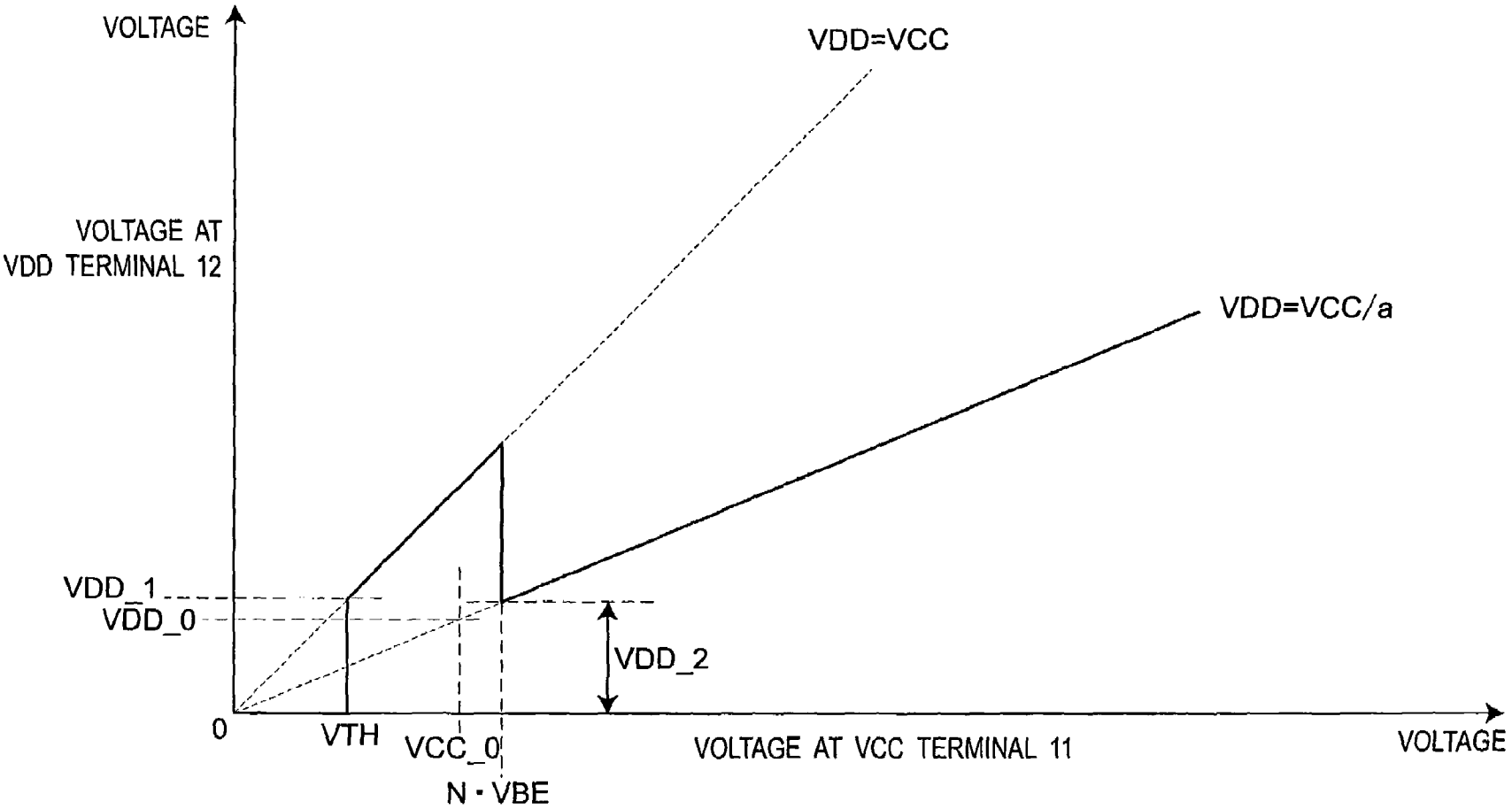
FIG. 6 is a correlation diagram showing a correlation between voltages at the VCC terminal 11 and the VDD terminal 12 on start-up of the reference supply voltage circuit 3B shown in FIG. 5.

Next, referring to FIG. 6, an operation of the semiconductor device provided with the reference supply voltage circuit 3B according to the present preferred embodiment will be described. FIG. 6 is a correlation diagram showing a correlation of voltages at the VCC terminal 11 and the VDD terminal 12 on start-up of the semiconductor device provided with the reference supply voltage circuit 3B as configured in FIG. 5. In FIG. 6, VDD_0 is the minimum voltage at the VDD terminal 12 at which a circuit, which operates using the voltage at the VDD terminal 12 as the reference voltage, can be stably operated. When the voltage at the VDD terminal 12 is lower than the voltage VDD_0, the circuit becomes unstable. VCC_0 shows the minimum voltage at the VCC terminal 11 at which the first operation circuit 5, which operates using the voltage at the VCC terminal 11 as the reference voltage, can be stably operated. That is, when the voltage at the VCC terminal 11 is lower than the voltage VCC_0, the first operation circuit 5 which operates using the voltage at the VCC terminal 11 as the reference voltage becomes unstable. In addition, the threshold voltage VTH of the field-effect transistor 22 in the circuit 7B for preventing any false operation during the pre-operation indefinite time interval is preliminarily set to satisfy a relationship of VTH>VDD_0.

First of all, when the power supply 1 is applied, the capacitor 15 connected to the VCC potential is charged by the VCC electric power supplying circuit 2, and the voltage at the VCC terminal 11 gradually increases. In a state where the voltage at the VCC terminal 11 is lower than the threshold voltage VTH of the transistor 22, the transistor 22 does not operate, and therefore, the voltage at the VDD terminal 12 is maintained to zero potential that is the circuit reference voltage. When the voltage at the VCC terminal 11 further increases and reaches equal to or higher than the threshold voltage VTH of the transistor 22, the transistor 22 becomes in the ON-state and the voltage at the VDD terminal 12 is switched over from zero potential to the voltage VDD_1 equal to the voltage at the VCC terminal 11. At this time, the voltage VDD_1 satisfies a relationship of VDD_1>VDD_0. Therefore, the second operation circuit 6 which operates using the voltage at the VDD terminal 12 as the reference voltage can be stably operated. The circuit reference block 4 outputs the V1 signal having the high level which controls the second operation circuit 6 to be in the operation state. The voltage at the VDD terminal 12 becomes a value equal to the voltage at the VCC terminal 11 until the voltage at the VCC terminal 11 reaches from the voltage VTH to the voltage N·VBE.

Next, when the voltage at the VCC terminal 11 further increases and reaches the voltage N·VBE, the N bipolar transistors T1 to TN become in the conductive state, and the transistor 21 becomes in the ON-state. Therefore, the voltage at the gate electrode of the transistor 21 becomes equal to the voltage at the VCC terminal 11, and the transistor 22 becomes in the OFF-state. Accordingly, the voltage at the VDD terminal 12 decreases to the voltage VDD_2 obtained by subtracting the threshold voltage VBE of the transistor 25 from a voltage divided by resistors 23 and 24 of the VDD electric power supplying circuit 8. At this time, the first operation circuit 5 which operates using the voltage at the VCC terminal 11 as the reference voltage can be stably operated. The comparator 10A outputs the V2 signal having the high level which controls the first operation circuit 5 to be in the operation state. In addition, at this time, since the voltage VDD_2 is preliminarily set to satisfy a relationship of VDD_2>VDD_0, the second operation circuit 6 which operates using the voltage at the VDD terminal 12 as the reference voltage can be continuously stably operated. After that, the voltage at the VDD terminal 12 increases in proportion to the voltage at the VCC terminal 11 until the voltage at the VCC terminal 11 further increases and reaches a constant level. When the voltage at the VCC terminal 11 reaches the constant level, the second operation circuit 6 outputs the V3 signal to the VCC electric power supplying circuit 2, and controls the output voltage at the VCC electric power supplying circuit 2 to be constant.

As described above, according to the reference supply voltage circuit 3B according to the present preferred embodiment, a reference supply voltage circuit having effects equivalent to those in the preferred embodiment 1 can be easily realized by the above circuit configuration. In addition, the voltage N·VBE which is used for switching the voltage at the VDD terminal 12 can be easily adjusted to other values by adjusting the number of the bipolar transistors T1 to TN.

Further, referring to FIG. 5, the type of bipolar transistors T1 to TN is the same as that of the bipolar transistor 25 in the VDD electric power supplying circuit 8A. However, the present invention is not limited to this configuration, but the type of the bipolar transistors T1 to TN may be different from that of the bipolar transistor 25.

The present invention can be applied to a reference supply voltage circuit for a semiconductor device or the like for use in a switching power supply or the like, for example.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A reference supply voltage circuit for generating a second reference voltage based on a first reference voltage generated by an electric power supplying circuit, and supplying the second reference voltage to an operation circuit, said reference supply voltage circuit comprising:

a detecting device for detecting the first reference voltage;

a comparator for outputting a signal which controls an operation state and a stop state of the operation circuit by comparing the first reference voltage detected by said detecting device with a predetermined reference detection voltage; and a circuit for preventing any false operation during a pre-operation indefinite time interval for inputting the first reference voltage, for maintaining the second reference voltage at a zero voltage when the first reference voltage is lower than a first predetermined voltage, for setting the second reference voltage to a voltage equal to the first reference voltage when the first reference voltage is equal to or higher than the first predetermined voltage and lower than a second predetermined voltage, for setting the second reference voltage to a voltage proportional to the first reference voltage when the first reference voltage is equal to or higher than the second predetermined voltage, and for supplying the second reference voltage to the operation circuit.

2. The reference supply voltage circuit as claimed in claim 1, wherein the first predetermined voltage is equal to or higher than a voltage at which the operation circuit whose supply voltage is the second reference voltage can be stably operated; and wherein the second predetermined voltage is equal to or higher than a voltage at which a further operation circuit whose supply voltage is the first reference voltage can be stably operated.

3. The reference supply voltage circuit as claimed in claim 1, wherein said circuit for preventing any false operation during the pre-operation indefinite time interval comprises:

a diode section having a cathode electrode connected to a ground potential, for supplying a forward voltage that is the second predetermined voltage;

a first resistor connected between the first reference voltage and an anode electrode of said diode section;

a first switching device having one side electrode connected to the first reference voltage, the other side electrode connected to the ground potential via a second resistor, and a control electrode connected to the anode electrode of said diode section; and a second switching device having one side electrode connected to the first reference voltage, the other side electrode connected to the second reference voltage, and a control electrode connected to a connecting node between said second resistor and said first switching device.

4. The reference supply voltage circuit as claimed in claim 2, wherein said circuit for preventing any false operation during the pre-operation indefinite time interval comprises:

a diode section having a cathode electrode connected to a ground potential, for supplying a forward voltage that is the second predetermined voltage;

a first resistor connected between the first reference voltage and an anode electrode of said diode section;

a first switching device having one side electrode connected to the first reference voltage, the other side electrode connected to the ground potential via a second resistor, and a control electrode connected to the anode electrode of said diode section; and a second switching device having one side electrode connected to the first reference voltage, the other side electrode connected to the second reference voltage, and a control electrode connected to a connecting node between said second resistor and said first switching device.

5. The reference supply voltage circuit as claimed in claim 3, wherein said diode section comprises a plurality of diodes connected in series with each other.

6. The reference supply voltage circuit as claimed in claim 4, wherein said diode section comprises a plurality of diodes connected in series with each other.

7. The reference supply voltage circuit as claimed in claim 3, wherein said diode section comprises a plurality of bipolar transistors connected in series with each other.

8. The reference supply voltage circuit as claimed in claim 4, wherein said diode section comprises a plurality of bipolar transistors connected in series with each other.

9. The reference supply voltage circuit as claimed in claim 3, wherein said first and second switching devices are P-type transistors, respectively.

10. The reference supply voltage circuit as claimed in claim 4, wherein said first and second switching devices are P-type transistors, respectively.

* * * * *